US010315785B2

(12) United States Patent
Rea et al.

(10) Patent No.: US 10,315,785 B2
(45) Date of Patent: Jun. 11, 2019

(54) UNIT AND METHOD FOR FILLING CONTAINERS FORMING SINGLE-USE CAPSULES FOR EXTRACTION OR INFUSION BEVERAGES

(71) Applicant: GIMA S.p.A., Zola Predosa (Bologna) (IT)

(72) Inventors: Dario Rea, Monterenzio (IT); Pierluigi Castellari, Castel San Pietro Terme (IT)

(73) Assignee: GIMA S.p.A., Zola Predosa (Bologna) (IT)

( * ) Notice: Subject to any disclaimer, the term of this patent is extended or adjusted under 35 U.S.C. 154(b) by 14 days.

(21) Appl. No.: 15/116,645

(22) PCT Filed: Feb. 3, 2015

(86) PCT No.: PCT/IB2015/050816
§ 371 (c)(1),
(2) Date: Aug. 4, 2016

(87) PCT Pub. No.: WO2015/118446
PCT Pub. Date: Aug. 13, 2015

(65) Prior Publication Data

US 2016/0347484 A1 Dec. 1, 2016

(30) Foreign Application Priority Data

Feb. 6, 2014 (IT) ..... BO2014A0052

(51) Int. Cl.
*B65B 1/36* (2006.01)
*B65B 29/02* (2006.01)

(52) U.S. Cl.
CPC ..... *B65B 1/36* (2013.01); *B65B 29/02* (2013.01); *B65B 29/022* (2017.08)

(58) Field of Classification Search
CPC ..... B65B 1/36; B65B 29/02; B65B 29/022; B65B 29/025; B65B 29/028; B65B 1/363; B65B 1/366; B65B 1/38; B65B 37/20
See application file for complete search history.

(56) References Cited

U.S. PATENT DOCUMENTS 2,567,052 A * 9/1951 Carruthers ..... B65B 63/022 100/178
2,613,864 A * 10/1952 Carter ..... B65B 1/26 137/103

(Continued)

FOREIGN PATENT DOCUMENTS

WO WO 92/20579 A1 11/1992
WO WO 01/34475 A1 5/2001
WO WO 2013/144837 A1 10/2013

OTHER PUBLICATIONS

International Search Report and Written Opinion for corresponding Patent Application No. PCT/IB2015/050816 dated May 7, 2015.

(Continued)

*Primary Examiner* — Andrew D Stclair
(74) *Attorney, Agent, or Firm* — Renner, Otto, Boisselle & Sklar, LLP

(57) ABSTRACT

Described is a unit for filling containers (2) forming single-use capsules (3) with a dose (33) of product for extraction or infusion beverages, comprising: a line (4) for transport of the containers (2); a station (SR) for filling the containers (2) with a dose (33) of product and comprising: a first containing seat (S1) designed to receive a dose (33) of product; a device (10) for moving the first seat (S); a device (11) for adjusting the position of the first containing seat (S1) between a position (P1) for receiving the dose and a position (P2) for releasing the dose; a substation (ST1) for forming the dose (33) inside the first containing seat (S1); a substation (ST3) for releasing the dose (33) of product from the (Continued)

first containing seat (S1) to a container (2) transported by the transport line (4), the adjusting device (11) being configured to place the first containing seat (S1) in the receiving position (P1) at the substation (ST1) for forming the dose (33) and in the release position (P2) at the substation (ST3) for releasing the dose (33).

19 Claims, 10 Drawing Sheets

(56) References Cited

U.S. PATENT DOCUMENTS

| | | | | | |
|---|---|---|---|---|---|
| 3,578,778 | A * | 5/1971 | Matthews | B65B 1/366 | 141/144 |
| 5,649,412 | A * | 7/1997 | Binacchi | B65B 9/023 | 426/77 |
| 5,694,741 | A * | 12/1997 | Weder | B65B 1/363 | 53/253 |
| 5,791,127 | A | 8/1998 | Rossi | | |
| 6,098,675 | A * | 8/2000 | Runft | B65B 1/363 | 141/71 |
| 2010/0059069 | A1 * | 3/2010 | Boldrini | B65B 1/363 | 131/112 |

OTHER PUBLICATIONS

Search Report for corresponding Italian Patent Application No. ITBO20140052 dated Feb. 6, 2014.

* cited by examiner

UNIT AND METHOD FOR FILLING CONTAINERS FORMING SINGLE-USE CAPSULES FOR EXTRACTION OR INFUSION BEVERAGES

This application is a national phase of International Application No. PCT/IB2015/050816 filed Feb. 2, 2015 and published in the English language, which claims priority to Italian Patent Application No. BO2014A000052 filed Feb. 6, 2014, which are hereby incorporated herein by reference in their entirety.

TECHNICAL FIELD

This invention relates to a unit and a method for filling containers with a dose of product. Advantageously, the containers may define single-use capsules for extraction or infusion beverages.

BACKGROUND ART

The prior art capsules, used in machines for making extraction or infusion beverages, comprise in their simplest form, the following:

- a rigid, cup-shaped outer container comprising a perforatable or perforated bottom and an upper aperture provided with a rim (and usually, but not necessarily, having the shape of a truncated cone);
- a dose of product for extract or infusion beverages contained in the outer container;
- and a length of sheet obtained from a web for sealing (hermetically) the aperture of the rigid container and designed (usually but not necessarily) to be perforated by a nozzle which supplies liquid under pressure.

Usually, but not necessarily, the sealing sheet is obtained from a web of flexible material.

In some cases, the capsules may comprise one or more rigid or flexible filtering elements.

For example, a first filter (if present) may be located on the bottom of the rigid container. A second filter (if present) may be interposed between the piece of sealing sheet and the product dose.

The dose of product may be in direct contact with the rigid, cup-shaped outer container, or with a filtering element.

The capsule made up in this way is received and used in specific slots in machines for making beverages.

In the technical sector in question, the need is particularly felt for filling in a simple and effective way the rigid, cup-shaped containers or the filtering elements whilst at the same time maintaining a high productivity.

It should be noted that, in this regard, there are prior art packaging machines having a filling unit which allows the simultaneous filling of several parallel rows of rigid, cup-shaped containers, which are advancing. In this case, each row of rigid, cup-shaped containers is associated with a dedicated filling device, generally equipped with a screw feeder to allow the descent of the product inside the container.

This type of unit is therefore obviously quite expensive and complex, since it comprises a plurality of devices and drives (one for each screw device) which are independent from each other and which must necessarily be coordinated.

Moreover, the overall reliability of the machine resulting from this configuration/arrangement of elements is necessarily limited because the rate of faults is inevitably linked with the number of devices and drives present.

Moreover, the screw feeder devices may have drawbacks due to clogging, soiling and poor dosing accuracy. More in detail, the end part of the screw feeder is not normally able to retain the product, which therefore falls and soils the machine.

A strongly felt need by operators in this sector is that of having a unit and a method for filling containers (rigid, cup-shaped containers, or filtration elements) forming single-use capsules for extraction or infusion beverages which are particularly simple, reliable and inexpensive and at the same time maintain a high overall productivity.

AIM OF THE INVENTION

The aim of this invention is therefore to satisfy the above-mentioned need by providing a unit and a method for filling containers (rigid, cup-shaped containers) forming single-use capsules for extraction or infusion beverages which can be made relatively simply and inexpensively and which is particularly reliable.

Another aim of the invention is to provide a machine for packaging single-use capsules for extraction or infusion beverages which can guarantee a high productivity.

BRIEF DESCRIPTION OF THE DRAWINGS

The technical features of the invention, with reference to the above aims, are clearly described in the claims below and its advantages are apparent from the detailed description which follows, with reference to the accompanying drawings which illustrate a non-limiting example embodiment of the invention and in which:

DETAILED DESCRIPTION OF PREFERRED EMBODIMENTS OF THE INVENTION

Figure 1:
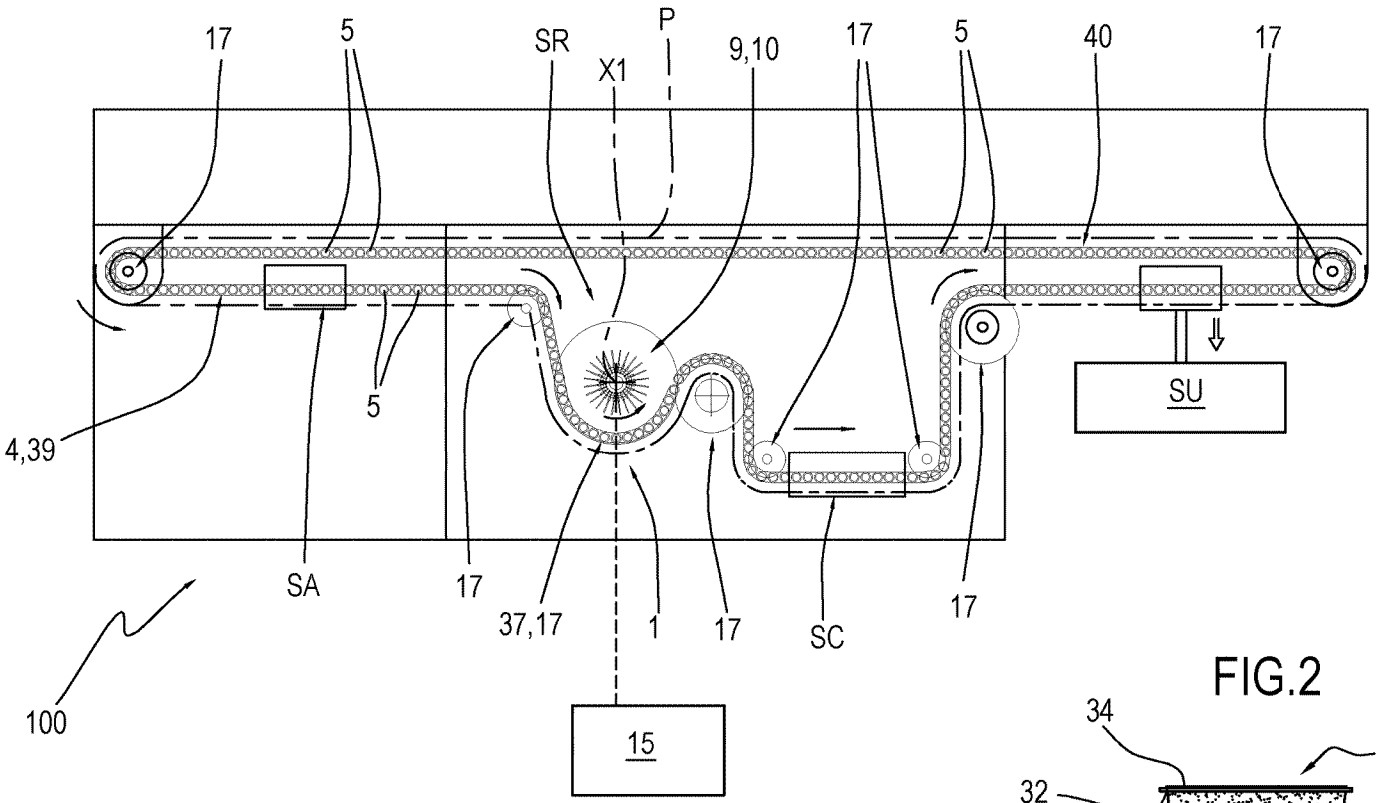
FIG. 1 is a schematic view of a machine for packaging containing elements of single-use capsules for extraction or infusion beverages comprising a filling unit according to a preferred embodiment of the invention.

With reference to the accompanying drawings, the numeral 1 denotes a unit for filling containers 2 forming single-use capsules 3 for extraction or infusion beverages, with a dose 33 of solid product in powder, granules or leaves, such as coffee, tea, milk, chocolate, or combinations of these.

The filling unit 1 is particularly suitable for filling containers 2 forming single-use capsules 3 with products in powder, preferably coffee.

Figure 2:
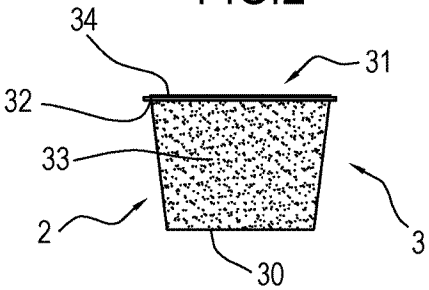
FIG. 2 is a schematic view of a single-use capsule for beverages which can be made by the machine of FIG. 1.

More specifically, as illustrated in FIG. 2, the single-use capsules 3 for extraction or infusion beverages comprise, in a minimum, but non-limiting, embodiment: a rigid, cup-shaped container 2 (usually to define a frustoconical shape) comprising a base 30 and an upper opening 31 equipped with a collar 32; a dose 33 of extraction or infusion product contained in the rigid container 2 and a lid 34 for closing the upper opening 31 of the rigid container 2.

The capsule 3 may comprise one or more filtering or product retaining elements (not illustrated here for simplicity reasons).

In the capsule 3 illustrated in FIG. 2, the rigid, cup-shaped body 2 defines the container to be filled with a dose 33 of product.

Other types of capsules may be filled with the filling unit according to the invention, for example capsules wherein the dose 33 of product is contained in, and retained by, a filtering element connected to the rigid container, wherein the rigid container can be closed at the bottom, or open.

In other words, in capsules not illustrated, a filtering element may contain and retain the dose 33 of product, forming the container in combination with the rigid body with which it is coupled.

In the following description, reference will be made to the rigid, cup-shaped body 2 as the container, but it is understood that the invention can be made with reference to capsules wherein the container is formed by a filtering element (or other components of the capsule designed to contain a dose 33 of product) and by the respective rigid body to which it is connected.

It should be noted that the filling unit 1 comprises a line 4 for transport (that is to say, movement) of rigid, cup-shaped containers 2 designed to contain a predetermined quantity of extraction or infusion product (dose 33) and a filling station SR.

The transport line 4 extends along a first movement path P and is provided with a plurality of seats 5 for supporting the rigid containers 2, arranged in succession along the first path P. Preferably, the first movement path P is a closed path lying on a horizontal plane.

The supporting seats 5 are arranged one after another, not necessarily continuously. In addition, the supporting seats 5 each have a corresponding vertical axis of extension.

The transport line 4 comprises a transport element 39 to which the supporting seats 5 are connected to be moved along the first path P.

The transport element 39 is closed in a loop around movement means 17 which rotate about vertical axes for moving the transport element 39.

Preferably, the transport element 39 is a chain 40 comprising a plurality of links, hinged to one another in succession about corresponding vertical axes, to form an endless loop.

At least one of the links comprises at least one supporting seat 5 with a vertical axis for corresponding rigid container 2 which can be positioned with the opening 31 facing upwards.

It should be noted that the chain 40 may comprise both links having a corresponding supporting seat 5 and connecting links which are not provided with supporting seats 5 and which are interposed between links provided with supporting seats 5. Therefore, preferably, a certain number of links comprises each supporting seat 5.

Alternatively, in an embodiment not illustrated, the transport element 39 may comprise a flexible belt to which the supporting seats 5 for the rigid containers 2 are fixed.

Preferably, but not necessarily, the movement means 17 rotate continuously about vertical axes to allow the transport element 39 to move continuously.

Described below is the station SR for filling the rigid, cup-shaped containers 2.

Figure 3:
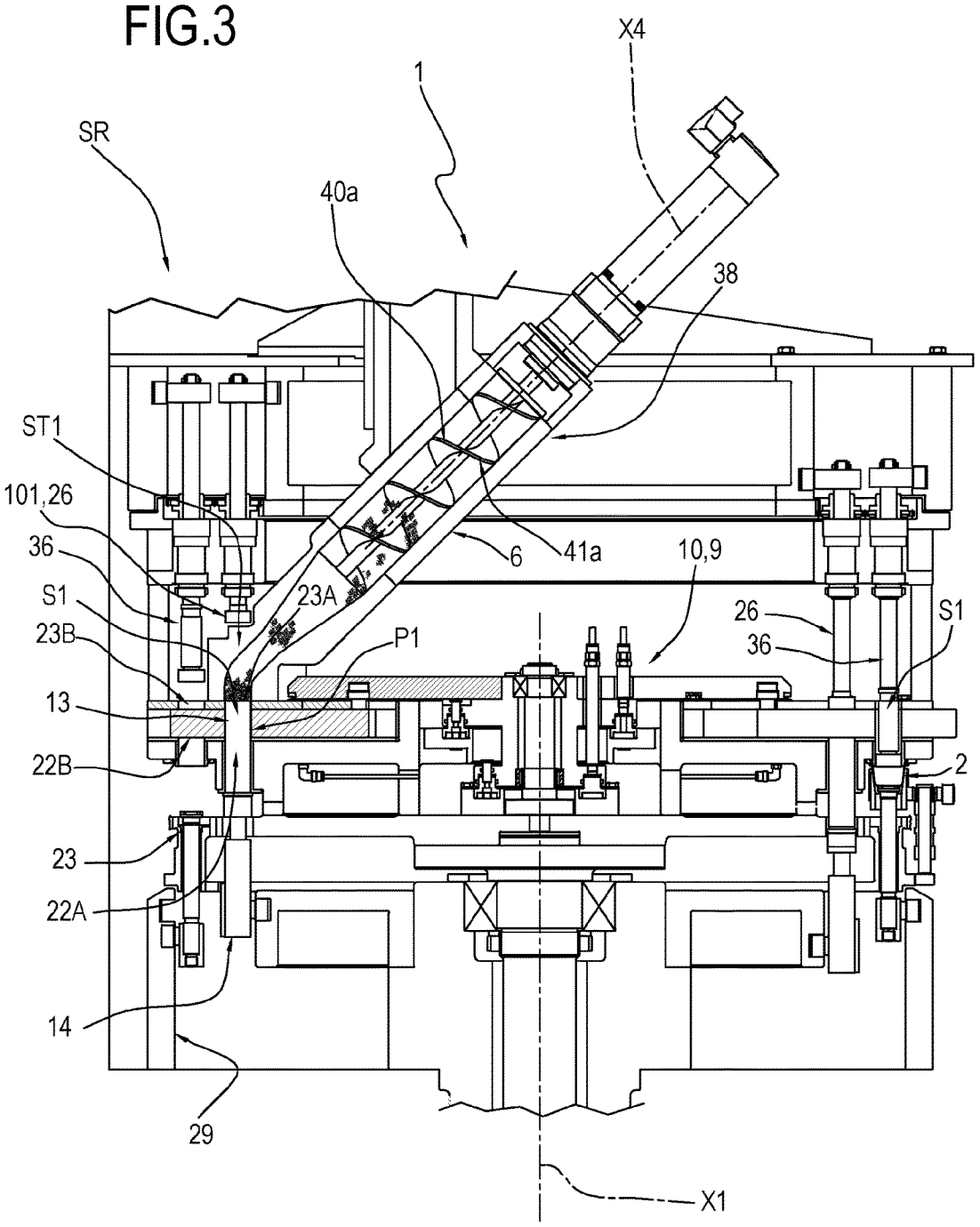
FIG. 3 is a schematic side view of the filling unit present in the machine according to the invention and present in the machine of FIG. 1.
Figure 4:
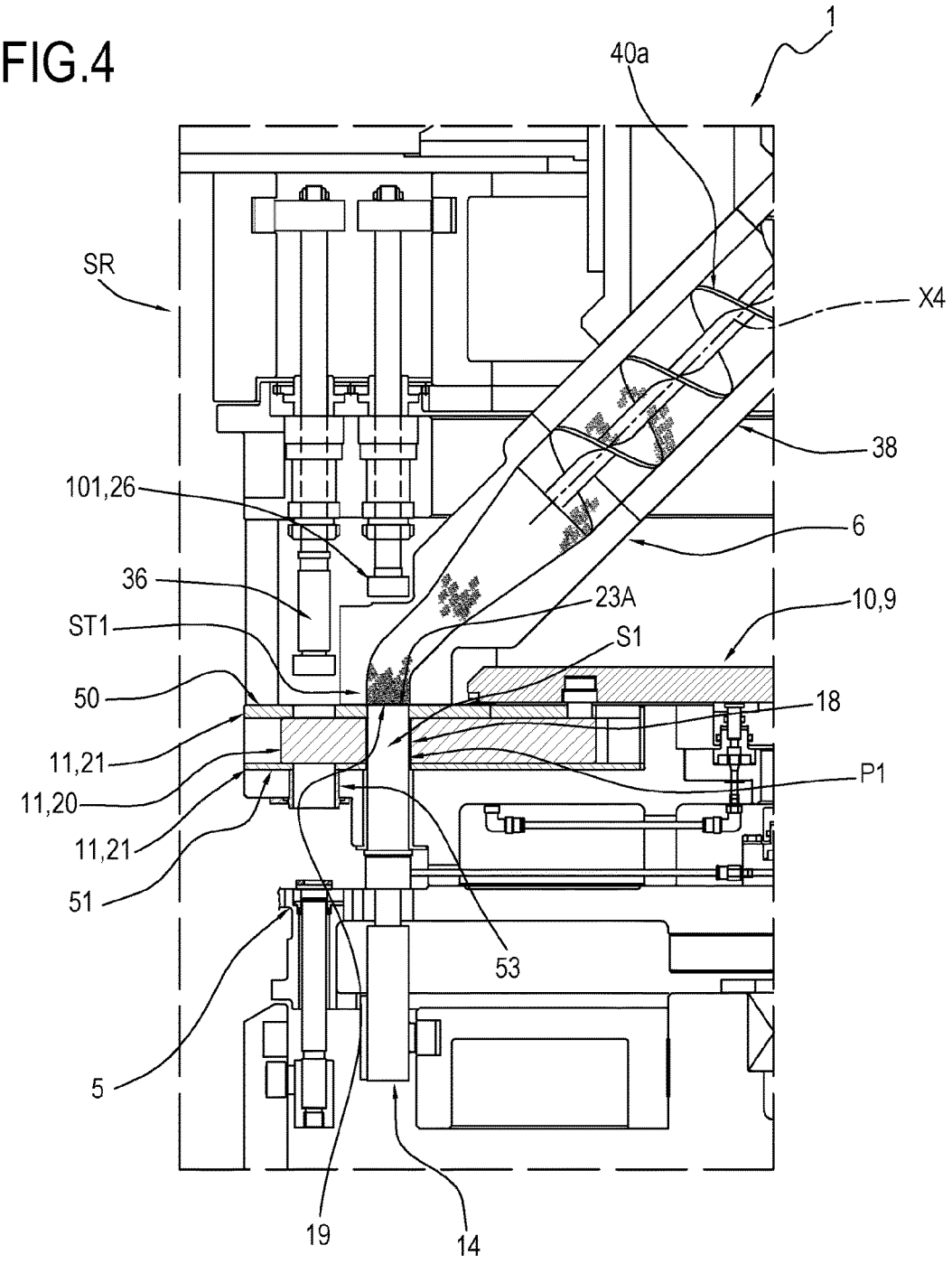
FIGS. 4 to 8 show respective side views partly in cross section of the filling unit of FIG. 3 according to different operating steps.
Figure 5:
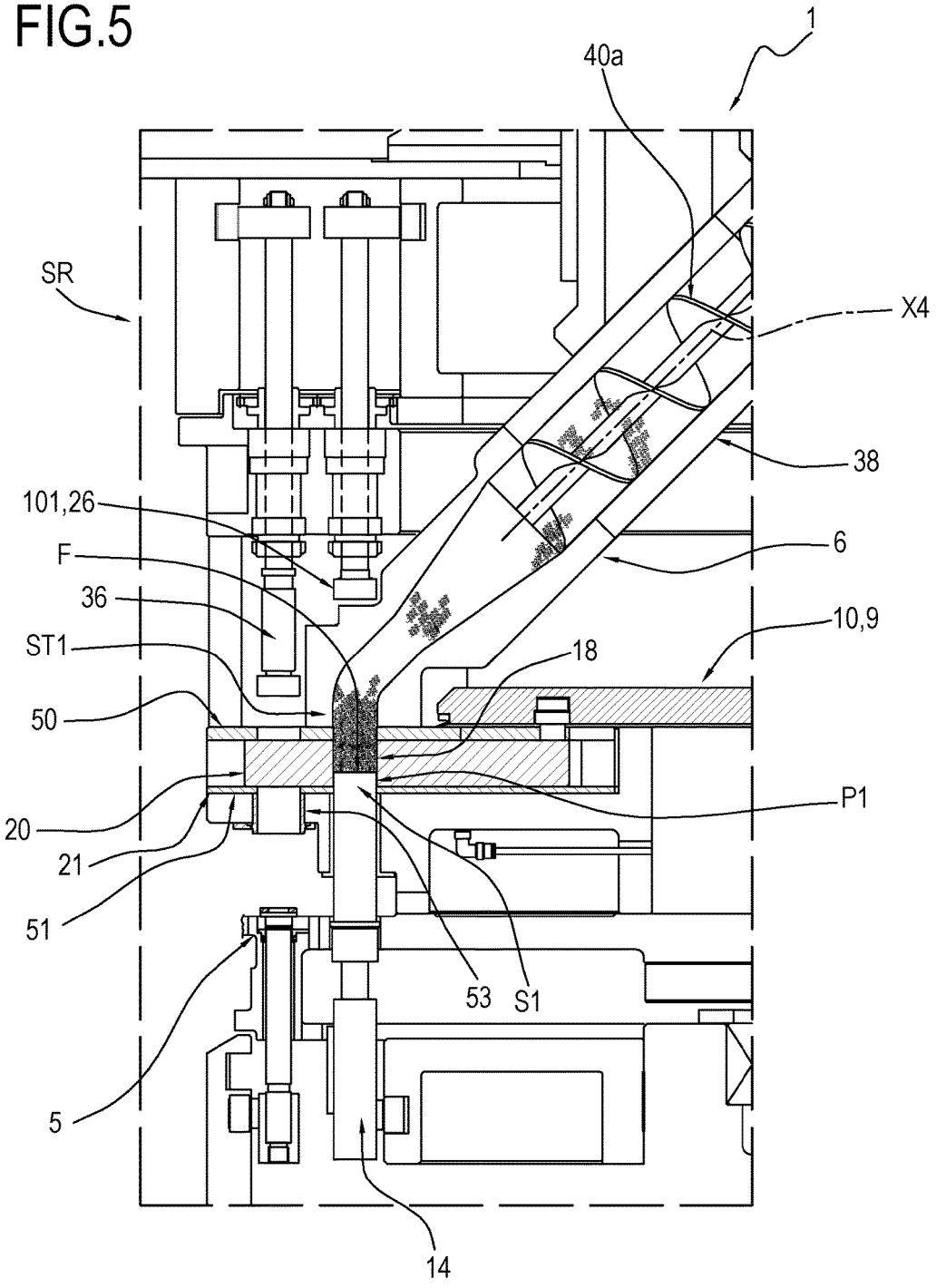
Figure 6:
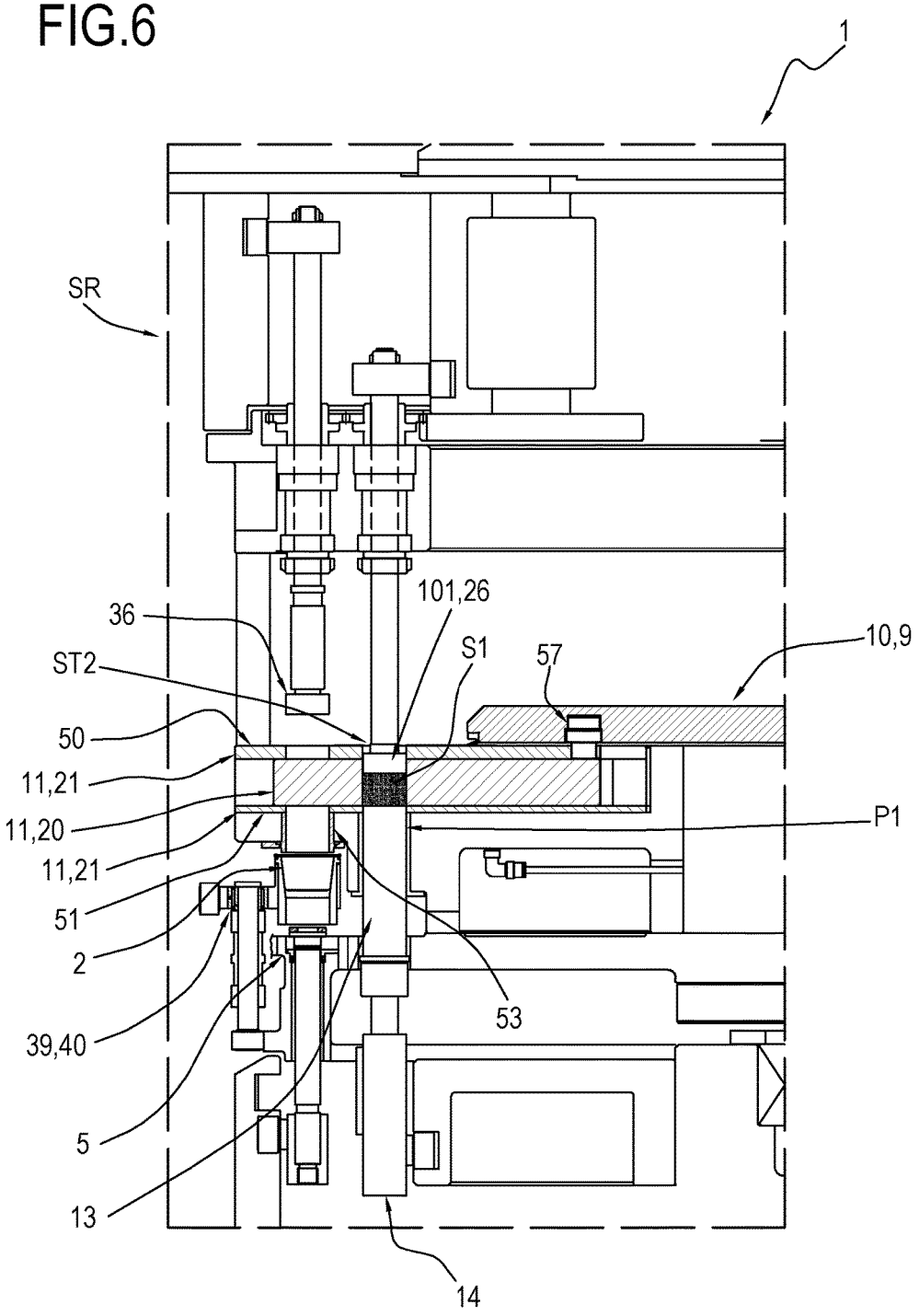
Figure 7:
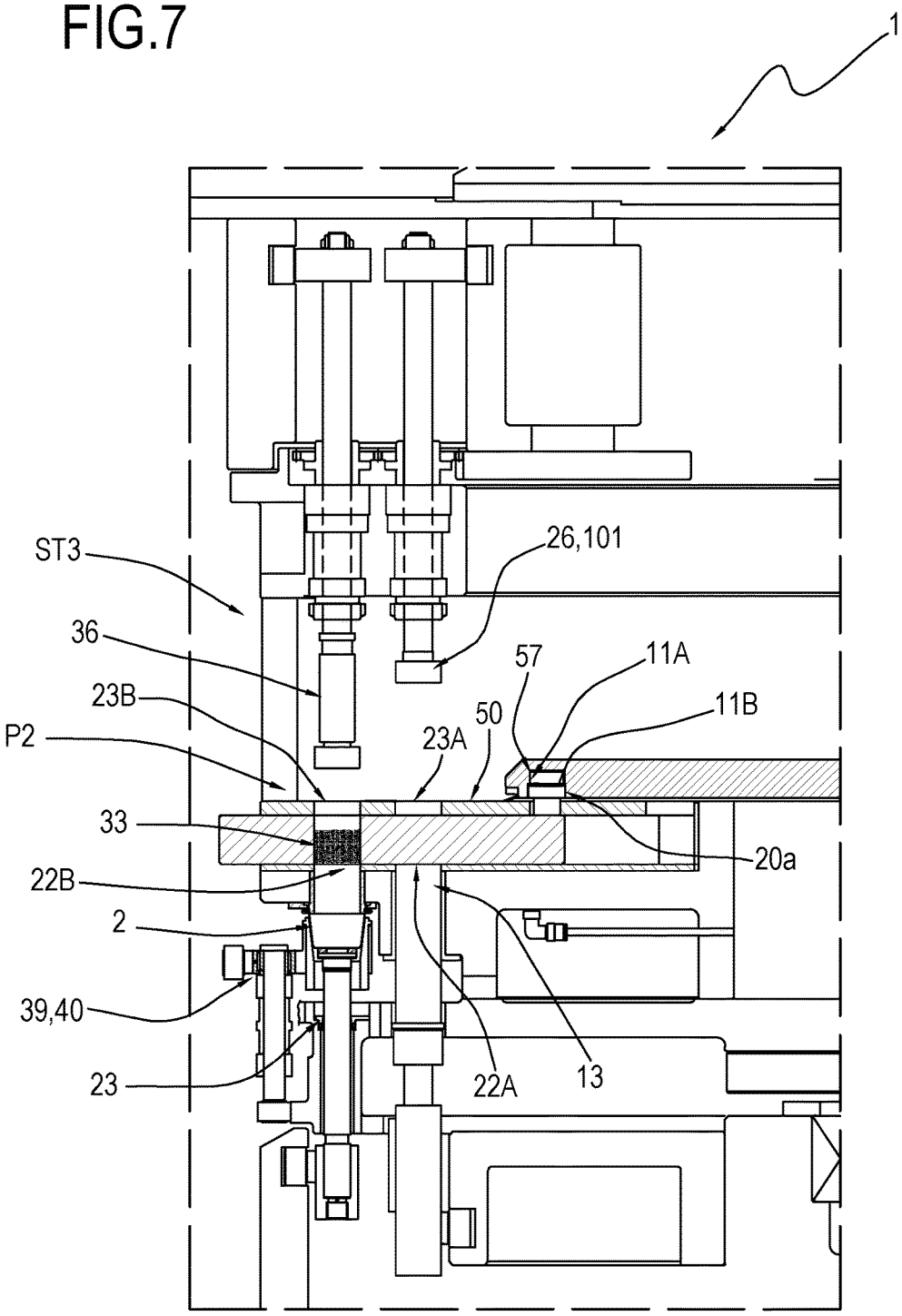
Figure 8:
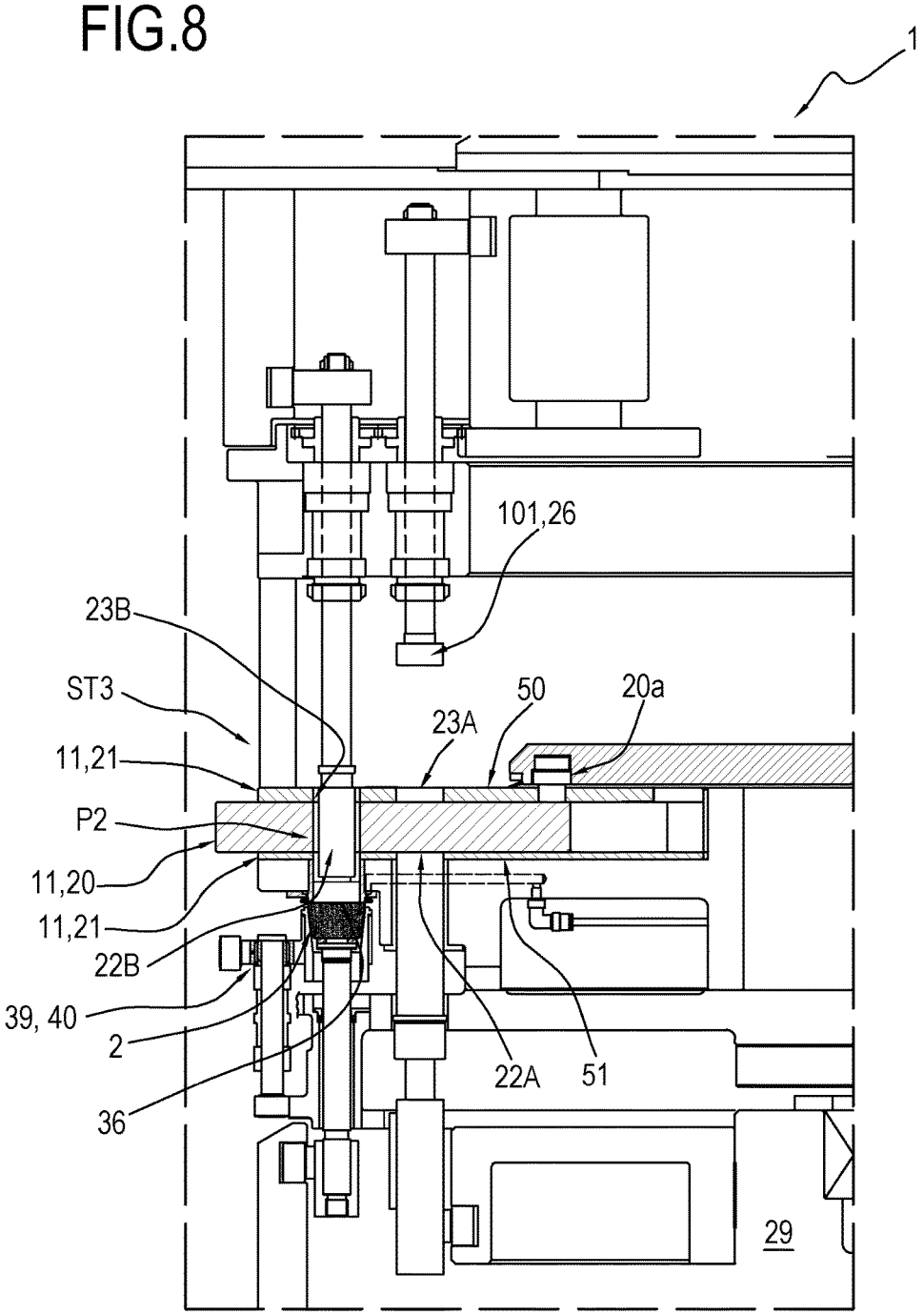

The station SR for filling the rigid, cup-shaped containers 2 comprises:

at least one first containing seat S1 (hereinafter referred to as first seat S1 or also as a first receiving seat S1) designed to receive a dose 33 of product;

a device 10 for moving the first seat S1 along a closed path PS;

a device 11 for adjusting the position of the first seat S1, configured for adjusting the position of the first seat S1 along the closed path PS, between a position P1 for receiving the dose 33 and a position P2 for releasing the dose 33 inside one of the containers 2;

a substation ST1 for forming the dose 33 inside the at least one first containing seat S1, provided with a device 6 for releasing a predetermined quantity of product forming the dose 33 inside the at least one first containing seat S1 located in the position P1 for reception of the dose;

a substation ST3 for releasing the dose 33 of product from the at least one containing seat S1 positioned in the position P2 for releasing the dose to a container 2 transported by the transport line 4;

It should be noted that for reasons of clarity, only part of the product in the release device 6 is illustrated in FIGS. 3 to 5. In reality, the release device 6 is, in operating conditions, normally full of product to be dosed.

The device 11 for adjusting the position is configured to place the at least one first seat S1 in the position P1 for receiving at the substation ST1 for forming the dose 33 and in the position P2 for releasing the dose at the substation ST3 for releasing the dose 33.

All the above-mentioned components forming part of the filling station SR of the rigid, cup-shaped containers 2 are described below in more detail, with particular reference to the accompanying drawings.

It should be noted that the device 10 for moving the first containing seat S1 comprises a first element 9 rotating about a first axis X1 of rotation which is substantially vertical, on which is connected the first containing seat S1 to be rotated about the first vertical axis X1 of rotation.

The first element 9 comprises a wheel, and the movement device includes the wheel connected to a driver for driving the rotation (for example, connected to a drive unit, not illustrated here).

The first seats S1 are connected radially to the first rotary element 9 to be rotated with it. Preferably, the first seats S1 are positioned along an arc of a circle of the rotary element 9, even more preferably they are positioned along the entire circumference having as the centre a point of the first axis X1.

Still more preferably, the first seats S1 are angularly equispaced from each other along a circumference having as the centre a point of the first axis X1.

It should be noted that each first seat S1 is moved by the first rotary element 9 in rotation so as to engage cyclically—during the rotation—the substations for forming ST1 and releasing ST3 the dose.

In the embodiment illustrated in the accompanying drawings, the first containing seats S1 are supported by the first rotary element 9 in a radially movable fashion.

According to this aspect, the adjustment device 11 is configured to move the at least one first seat S1 radially relative to the first axis X1 of rotation between the position P1 for receiving the dose and the position P2 for releasing the dose.

More specifically, the adjustment device 11 is configured to move the at least one first seat S1 radially in a forward stroke from the position P1 for receiving the dose to the position P2 for releasing the dose and according to a return stroke from the position P2 for releasing the dose to the position P1 receiving the dose.

In the embodiment illustrated, the first seat S1 is formed in an element 20 for containing the dose (preferably having an elongate shape).

Preferably, the first seat S1 is a through seat.

In other words, the first through seat S1 extends between an upper face and a lower face of the above-mentioned element 20 for containing the dose.

Preferably, the first seat S1 has a cylindrical shape, that is, it has a circular cross section.

According to another aspect, the filling unit 1 comprises an element 21 for housing the element 20 for containing the dose, provided with openings upper (23A, 23B) and lower openings (22A, 22B).

Preferably, the housing element 21 is fixed to the rotary element 9, in such a way as to be rotated by the rotary element without the position being modified.

In practice, the housing element 21 defines a housing cavity, inside of which the element 20 for containing the dose is movably inserted to be movable between the position P1 for receiving the dose and the position P2 for releasing the dose.

Advantageously, the containing element 20 is movable on a horizontal plane.

A rotation of the rotary element 9 determines a rotation of the containing 21 and housing 20 elements.

The filling unit 1 also comprises a track, or cam, 57 having side walls 11A, 11B facing each other. The track 57 extends on a closed-loop path.

The element 20 for containing the dose is configured for engaging in the track 57 in such a way that the position of the element 20 for containing the dose along the closed path PS can be adjusted.

It should be noted that the track 57 is fixed relative to the frame 29 of the filling unit 1, that is, it is not rotated as one with the rotary element 9.

In practice, it should be noted that the element 20 for containing the dose is equipped with a portion, or cam follower, 20*a* designed to be inserted in the track 57.

It should be noted that the portion 20*a* and the track 57 define, in combination, a cam device configured for adjusting the position of the first seat S1 along the closed path PS.

It should also be noted that the containing element 20, the housing element 21 and the cam device (20*a*, 57) define the above-mentioned device 11 for adjusting the position of the first seat S1 along the closed path PS.

It should also be noted that the housing element 21 comprises an upper wall 50, provided with a first upper opening 23A and a second upper opening 23B.

The first upper opening 23A is located in a position close to the axis X1, whilst the second upper opening 23B is located in a position far from the axis X1.

The housing element 21 also comprises a lower wall 51, provided with a first lower opening 22A and a second lower opening 22B.

The first lower opening 22A is located in a position close to the axis X1, whilst the second lower opening 22B is located in a position far from the axis X1.

Preferably, the first upper opening 23A is vertically superposed on the first lower opening 22A. Preferably, the second upper opening 23B is vertically superposed on the second lower opening 22B.

The first and second openings (22A, 22B, 23A, 23B), are in communication with the housing cavity defined by the housing element 21 and inside of which the containing element 20 can move radially.

The containing element 20, therefore the first seat S1, is movable in such a way as to be positioned:

- in the first position P1 for receiving the dose 33, in a condition of vertical alignment with the first upper opening 23A and the first lower opening 22A, and
- in the second position P2 for receiving the dose 33, in a condition of vertical alignment with the second upper opening 23B and the second lower opening 22B.

In other words, when the first seat S1 is positioned vertically aligned with the first upper openings 23A and lower openings 22A, the first seat S1 is in the position P1 for receiving the dose, whilst when first seat S1 is positioned vertically aligned with the second upper openings 23B and lower openings 22B the first seat S1 is in the position P2 for releasing the dose 33.

Each first seat S1 is defined, preferably, by lateral walls of a cavity 18 and by a bottom wall F (the bottom wall F is a movable wall, that is to say, it may be defined by one or more elements as a function of the position of the first seat).

Preferably, the cavity 18 is a cylindrical cavity.

Furthermore, still more preferably, the cavity 18 has a vertical axis of extension (parallel to the first axis X1 of rotation).

Again, preferably, the filling station SR comprises, for each first seat S1:

- a first piston 13, which is movable between a lower position and an upper position and forming the above-mentioned bottom wall F of the first seat S1 when the first seat S1 is in the position P1 for receiving the dose;
- means 14 for moving the first piston 13 for moving the first piston 13 between the lower and upper positions in such a way as to adjust the volume inside the first seat S1.

Examples of movement means 14 are electric motors, pneumatic devices, cam devices, and other prior art devices.

Preferably, but not necessarily, the filling station SR comprises movement means 14 which are independent for each first piston 13, so that each piston 13 can be moved independently of the others.

It should be noted that each first piston 13 is rotated by the rotary element 9.

More specifically, the first pistons 13 are positioned in a predetermined radial position relative to the axis X1 of the rotary element 13.

According to another aspect, the filling unit 1 comprises a control unit 15, designed to control one or more moving elements of the unit.

The control unit 15 is configured to control, when the first seat S1 is positioned at the substation ST1 for forming the dose, the movement of the first piston 13 to place it in a predetermined position corresponding to a desired internal volume of the first seat S1.

In practice, as described in more detail below, the first piston 13 is positioned at a predetermined height, so that the first seat S1 has a predetermined and desired internal volume (which is filled by a predetermined quantity of product).

It should also be noted that the first piston 13 defines the bottom F of the first seat S1 at least at the forming substation ST1.

When the containing element 20 is moved from the first receiving position P1 to the second release position P2, the bottom wall 51 of the housing element 21 defines the bottom F of the first seat S1.

The forming ST1 and release ST3 substations of the dose 33 are positioned along the periphery of the first rotary element 9, in such a way as to be engaged cyclically by the first seats S1 during rotation around the first axis X1.

More specifically, the forming ST1 and release ST3 substations of the dose are arranged in a predetermined position relative to a frame 29 of the filling station SR, along the closed movement path P1 of the first seats S1. In a complete rotation of the first rotary element 9 each first seat S1 is positioned in the forming substation ST1 of the dose and in the release substation ST3 of the dose.

Advantageously, the filling unit 1 further comprises a substation ST2 for compacting the dose, configured to compact the dose inside the first seat S1. In alternative embodiments not illustrated, the station ST2 for compacting the dose can be omitted.

The compacting substation ST2 is located along the closed path PS between the substation ST1 for forming the dose and the substation ST3 for releasing the dose.

More specifically, the first seat S1 during rotation intercepts firstly (that is, it is positioned at) the forming station ST1, then the compacting station ST2 and lastly the substation ST3 for releasing the dose.

Preferably, the closed path PS is a curved path around the first axis X1.

Preferably, the closed path PS is a substantially circular path around the first axis X1.

Still more preferably, the closed path PS lies on a horizontal plane.

Described below is the substation ST1 for forming the dose 33.

The substation ST1 for forming the dose 33 is positioned in a region R1 for forming the dose 33.

At the substation ST1 for forming the dose 33 there is the release device 6, designed for releasing a predetermined quantity of product (defining the dose 33) inside the containing seat S1 positioned in the region R1 for forming the dose 33.

The releasing device 6 according to a first embodiment comprises a hopper 38 (filled, in use, with loose product) having at the bottom an outfeed for the product.

It should be noted that the hopper 38 is configured to create a layer of product at the region R1 for forming the dose 33 above the first seats S1, so as to release the product inside the first seat(s) S1 positioned, each time, in the forming region R1.

More specifically, the outfeed of the hopper 38 is shaped in such a way as to occupy a portion of the closed movement path P1 of the first seats S1.

More specifically, according to one embodiment, the outfeed of the hopper is in the form of an arc, centred on the first axis X1.

The outfeed of the hopper 38 releases the product to a plurality of first seats S1 positioned temporarily in the region R1, that is to say, opposite below the outfeed of the hopper 38.

In other words, the first seats S1, passing below the hopper 38, are filled with product, in a filling time which depends on the speed of transit of the first seats S1 in the forming region R1 and on the amplitude of the portion of the closed movement path PS of the first seats S1 occupied by the outfeed 19 of the hopper 38.

According to one embodiment, the release device 6 comprises at least a first rotary element 40*a*, designed to rotate about its axis of rotation X4.

The first axis of rotation X4 of the first rotary element 40*a* is fixed relative to the hopper 38, or equally, to the frame 29.

The first rotary element 40*a* is configured to create a flow of product under pressure which intercepts the at least one first seat S1 and to release the product inside the at least one first containing seat S1 in transit through the region R1 for forming the dose.

Preferably, the first rotary element 40*a* is operating in the region R1 for forming the dose on a seat S1, or on a plurality of seats S1 simultaneously in transit through the forming region R1.

It should be noted that the release device 6 also comprises drive means (such as, for example, a first drive unit), operatively coupled to the first rotary element 40*a* to rotate the rotary element 40*a*.

The first rotary element 40*a* preferably comprises an element 41*a* which defines a surface with a helical extension.

The helical surface extends—in a spiral shape—along the first axis of rotation X4 of the first rotary element 40*a*.

The first rotary element 40*a* also comprises a respective first shaft 42*a*, to which the element 41*a* is connected, defining a surface with a helical extension for being rotated.

The first shaft 42*a* is supported rotatably relative to the frame 29 of the filling unit 1.

The first shaft 42*a* extends along the first axis of rotation X4 of the first rotary element 40*a*.

It should be noted that the first rotary element 40*a* described above defines a screw feeder, which by rotation about the first axis of rotation X4 allows a feeding of the product along the direction of axial extension of the first axis of rotation X4.

According to a preferred embodiment, the first axis of rotation X4 of the first rotary element 40*a* is inclined relative to a horizontal plane. It should be noted that, in this embodiment, the product is fed from the first rotary element 40*a* angularly, according to the direction of extension of the axis of rotation X4, so that the motion of the product has, as well as a horizontal component, also a vertical component which favours the insertion of the product inside the first seat S1 in transit in the region R1 for forming the dose (slightly compressing the product inside the first seat S1).

The helical element 41*a* of the first rotary element 40*a* is rotated in such a way that the product is pushed, along the direction of extension of the first axis X4 of rotation, in such a way as to create a flow of product under pressure inside the hopper 38, the flow intercepting the first seat S1 to be filled, thereby filling the first seat S1.

It should be noted that the first rotary element 40*a* defines a unit for feeding the product inside the first seat S1.

Figure 12:
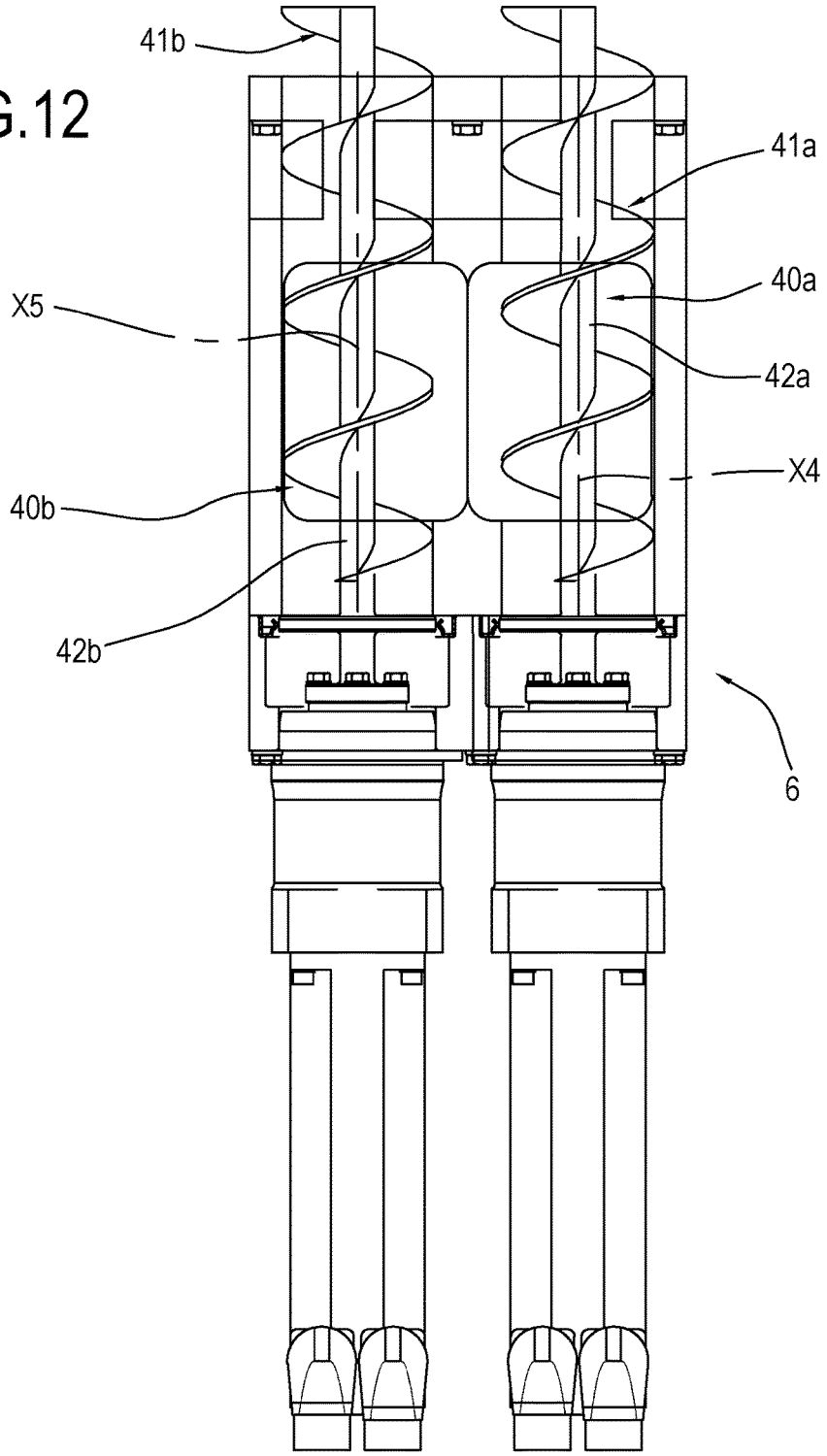

In a first embodiment, the release device 6 comprises, in addition to the first rotary element 40*a*, a second rotary element 40*b*, designed to rotate about a relative second axis of rotation X5 (FIG. 12).

It should be noted that the release device 6 also comprises drive means, operatively coupled to the first rotary element 40*a* and to the second rotary element 40*b* to rotate the second rotary element 40*b*.

The second axis of rotation X5 of the second rotary element 40*b* is parallel to the first axis X4.

With regard to the second rotary element 40*b*, all the considerations and the technical and functional features described with reference to the first rotary element 40*a* apply.

It should be noted that each of the two rotary elements (40*a*, 40*b*) is equipped with a respective helical element (41*a*, 41*b*) and a respective shaft (42*a*, 42*b*), to which a respective helical is connected for being rotated.

The second shaft 42*b* is supported rotatably relative to the frame 29 of the filling unit 1.

The second shaft 42*b* extends along the second axis of rotation X5 of the second rotary element 40*b*.

The second rotary element 40*b* also defines a screw feeder, which by rotation about the second axis of rotation X5 allows a feeding of the product along the direction of axial extension of the second axis of rotation X5.

Advantageously, the first rotary element 40*a* and the second rotary element 40*b* rotate accordantly, or discordantly.

It should be noted that the shafts 42*a*, 42*b* of the first and the second rotary element 40*a*, 40*b* are parallel to each other.

According to yet another aspect, it should be noted that the control unit 15 of the unit 1 (which advantageously also controls the machine 100) is designed to rotate the at least one first rotary element 40*a* of the release device 6 (and preferably also the second rotary element 40*b*) with a speed depending on the speed of movement of the first seat S1 by the first rotary unit 9.

Further, according to another aspect of the invention, the control unit 15 of the machine 100 is designed to rotate the at least one first rotary element 40*a* of the release device 6 (and preferably also the second rotary element 40*b*) with variable speed as a function of the quantity of product to be inserted inside each first seat S1.

More in detail, it is possible to increase the quantity of product inserted inside each seat S1 by increasing the speed of rotation of the first and/or secondary rotary element 40*a*, 40*b*, in such a way as to increase the apparent density of the product, and vice versa.

In other words, it is possible to vary the quantity of product contained in the first seat S1, and hence in the capsules 3, by adjusting the speed of rotation of the at least one first rotary element 40*a* (and second rotary element 40*b*).

The rotary element (40*a*, 40*b*) is associated with (positioned inside) the hopper 38, which also forms part of the release device 6.

It should be noted that the hopper 38 is defined by corresponding side walls, which are vertical and/or inclined.

More specifically, in the embodiment shown in the accompanying drawings, the filling unit 1 comprises a hopper 38 to which the first rotary element 40*a* and the second rotary element 40*b* are associated (positioned inside).

It should be noted that, advantageously, the presence of one or more rotary elements 40*a*, 40*b* prevents the product, in particular with powder type products (such as, for example, coffee), from creating blockages, that is, build-ups, inside the hopper which render incomplete the filling of the first seats S1 in transit through the region R1 for forming the dose. Indeed, it should be noted that the one or more rotary elements 40*a*, 40*b* are rotated so as to move the product and prevent the formation of any blockage inside the hopper 38 for feeding the product. In this way, advantageously, the speed at which the unit 1 may be used is particularly high and, consequently, the unit 1 is particularly fast and reliable in its operation.

With reference to the movement of the piston 13 in the region R1 for forming the dose, the following should be noted.

Preferably, when the above-mentioned first seat S1 is inside the region R1 for forming the dose, in particular at the infeed zone, the first piston 13 associated with the first seat S1 is positioned in a predetermined position (vertical) wherein it defines a predetermined space in the first seat S1.

According to a possible operating mode, the first piston 13 can be moved (vertically) from the top downwards in such a way that the first seat S1 is filled, not only by gravity acting on the product which causes the product to enter the seat S1, but also due to the suction effect on the product caused by the movement (displacement) of the piston 13 from an upper position to the desired (lower) position.

In this way, advantageously, thanks to the additional suction effect due to the lowering of the first piston 13, the resulting speed of the machine 100 at the filling station SR, in particular at the substation ST1 for forming the dose, is particularly high.

According to this invention, by varying the position (vertical) of the piston 13 by means of the movement means 14 in the region R1 for forming the dose 33 it is possible to vary the quantity of product contained in the first seats S1, or in other words, it is possible to vary the dose 33. Basically, the movement means 14 are designed to position the piston 13 in a desired dosing position at an outfeed zone of the region R1 for forming the dose 33, wherein a levelling element of the hopper 38 defines the dose 33. With reference to the compacting substation ST2, it should be noted that the compacting substation ST2 is equipped with compacting means 101 designed to compress the product, in phase with the piston 13, inside the first seat S1.

The compacting means 101 are described below in more detail.

In the example described, the compacting means 101 comprise a compacting element 26.

The compacting element 26, in the preferred embodiment illustrated, comprises a compacting piston.

It should be noted that the compacting element 26 is connected to the (carried by the) rotary element 9 of the filling station SR.

In practice, the compacting element 26 is rotated by the rotary element 9, as one with the first seat S1.

More specifically, the filling unit 1 preferably comprises a compacting element 26 associated with every containing seat S1.

The compacting element 26 is movable vertically, between a raised non-operating position and a lowered operating position.

It should be noted that the compacting element 26 is positioned in the lowered operating position at the substation ST2 for compacting the dose.

The compacting element 26 is positioned above the first piston 13.

In practice, the compacting element 26 is positioned relative to the rotary element 9 in a position such that in the lowered operating position it can be inserted through the first upper opening 23A of the upper wall 50 of the housing element 21.

On the other hand, the first piston 13 is positioned relative to the rotary element 9 in a position such that the first piston 13 can pass through the first lower opening 22A of the lower wall 51 of the housing element 21.

It should be noted that the lower face of the compacting element 26 defines, at the compacting region R2, an upper contact element of the dose 33 positioned inside the first seat S1, so as to compact the product.

In other words, the dose S1 is compressed between the first piston 13 and the compacting element 26, by the action of the compression applied by the latter.

Alternatively, once the dose 33 is formed, the first piston 13 can be moved to compact the product and the compacting element 26 act as a fixed contact element for the first piston 13. In other words, the drive and control unit 15 can move one or other, or both, between the first piston 13 and the compacting element 26 for compressing the dose 33.

It should also be noted that, according to an embodiment not illustrated, the filling unit 1 comprises a single compacting element 26 which is stationary relative to the frame 29 (that is, it is not rotated by the rotary element 9).

Alternatively, according to an embodiment not illustrated, the compacting element 26 may be omitted and replaced by an upper fixed contact element, for example a plate stationary relative to the frame 29.

According to another aspect, advantageously, the filling unit 1 further comprises at least one ejection device 36 movable at the substation ST3 for releasing the dose to abut (at the top) the dose 33 inside the at least one first containing seat S1 and eject it to the outside of the first seat S1 so as to release it inside the containing element 2 (located under the first seat S1 waiting).

Advantageously, the ejection device 36 is movable vertically.

More specifically, according to the embodiment illustrated in the accompanying drawings, the filling unit 1 comprises a plurality of ejection devices 36, with each of the ejection devices 36 being associated with a first seat S1.

Preferably, the ejection devices 36 comprise a piston, configured to abut the top of the dose 33 inside the first seat S1 at the substation ST3 for releasing the dose.

It should be noted that at the substation ST3 for releasing the dose, the closed path PS of the first seat S1 is positioned above the first movement path P of the transport line 4 (and hence of the containers 2).

These ejection devices 36 are movable between an upper non-operating position and a lower operating position, wherein they make contact (at the top) with the dose 33 inside the seat S1 to cause the ejection.

It should be noted that the ejection device 36 is positioned in the lowered operating position at the substation ST3 for releasing the dose 33, as described in more detail below.

The ejection device 36 is located above a piston 23 for lifting the container 2.

It should be noted that the unit 1 also comprises a piston 23 for lifting the container 2, which is movable at the substation ST3 for releasing the dose between a lower position and an upper position for lifting the container 2.

Advantageously, the lifting piston 23 is movable vertically.

Preferably, the filling unit 1 comprises a lifting piston 23 for each first containing seat S1; preferably, each piston 23 rotated by the rotary element 9 as one with the first seat S1. The lifting piston 23 may be driven by respective actuators, or by a fixed cam.

In practice, the ejection device 36 is positioned relative to the housing element 21 in a position such that in the lowered operating position the ejection device 36 can be inserted through the second upper opening 23B of the upper wall 50.

On the other hand, the lifting piston 23 is positioned relative to the housing element 21 in a position aligned relative to the second lower opening 22B.

It should be noted that the lower face of the ejection device 36 abuts at the top, at the region R3 for releasing the dose, the dose 33 positioned inside the first seat S1, in such a way as to push the product towards the outside of the seat S1 to release the dose inside the container 2 lifted by the lifting piston 23.

It should be noted that at the region R3 for releasing the dose 33 the container 2 is raised, for moving the container 2 to the second lower opening 22B and minimising the escape of product.

It should also be noted that, according to an embodiment not illustrated, advantageously in the case of step operation, the filling unit 1 comprises a single ejection device 36 which is stationary relative to the frame 29 of the unit 1.

The ejection device(s) 36 is/are movable, and operate on the first seat S1 at the release substation ST3.

According to an alternative embodiment not illustrated, the ejection device 36 may be omitted and the dose 33 may fall by gravity inside the container 2 when the seat S1 is located at the release position P2, that is, when the seat S1 is aligned with, that is, in fluid communication with, the second lower opening 22 B.

With reference to the compacting element(s) 26, the ejection devices 36, the first piston 13 and the piston lifting 23, it should be noted that the above-mentioned elements/devices (26, 36) and pistons (13, 23) are supported (vertically movable) by the rotary element 9, that is to say, they are positioned in a predetermined radial position.

The compacting element(s) 26, ejection device(s) 36, first piston(s) 13 and the lifting piston(s) 23 are movable vertically, as described above.

With reference to the filling unit 1 in its entirety, it should be noted that the unit 15 also comprises a unit (formed by one or more electronic cards) for drive and control of the devices for moving, respectively, the first seat S1.

Advantageously, the drive and control unit 15 is also configured to control the advance of the transport element 39 and the movable elements of the filling station SR (for example, the pistons 13 and 23, the compacting elements 26 and the ejecting devices 36).

It should be noted that the drive and control unit 15 coordinates and controls the step of moving all the above-mentioned elements connected to it, so as to allow the operations described below to be performed.

The filling unit 1 according to the invention may advantageously form part of a packaging machine 100 (illustrated in FIG. 1) designed for packaging single-use capsules for extraction or infusion beverages, for example of the type described above. The packaging machine 100 further comprises a plurality of stations, positioned along the first path P performed by the transport element 39, configured to operate in a synchronised fashion (preferably continuously) with the transport element 39 and with the filling station SR, comprising at least:

- a station SA for feeding rigid containers 2 into corresponding seats 5 of the transport element 39;
- a station SC for closing the rigid containers, in particular the upper opening 31 of the rigid container 2, with a lid 34;
- an outfeed station which picks up the capsules 3 from the respective seats 5 of the transport element 39.

In addition to the stations listed above (SA, SR, SC, SU), the packaging machine 100 may comprise further stations, such as, for example, one or more weighing stations, one or more cleaning stations, one or more control stations and, depending on the type of capsule to be packaged, one or more stations for applying filtering elements.

The operation of the filling unit 1 is briefly described below, in particular the filling station SR, with the aim of clarifying the scope of the invention: in particular, the filling of a rigid, cup-shaped container 2 is described with reference to the embodiment illustrated in the accompanying drawings (in particular FIGS. 4 to 8).

During movement (rotation) of the first rotary element 9, a first seat S1 designed to be filled with a dose 33 of product is positioned in the region R1 for forming the dose 33, that is to say, in the proximity of the substation ST1 for forming the dose 33.

It should be noted that the feeding device 6 feeds product in the region R1 for forming the dose 33, filling the first seat S1 at the forming region R1.

The movement of the first rotary element 9 is, preferably, a continuous type movement. Alternatively, the movement of the first rotary element 9 is of a step type.

More specifically, the first seat S1 is completely filled at the outfeed of the region R1 for forming the dose 33.

Advantageously, once the seat S1 has been filled, the filling unit 1 can operate a step for compacting the dose 33.

More specifically, from the substation ST1 for forming the dose, a rotation of the rotary element 9 by a predetermined angle moves the first seat from the substation ST1 for forming the dose to the substation ST2 for compacting the dose.

It should be noted that the containing element 20 (that is, the first seat S1) is kept in the position P1 for receiving the dose both at the substation ST1 for forming the dose and at the substation ST2 for compacting the dose.

At the compacting substation ST2, the compacting element 26 is moved from the top downwards, through the first upper opening 23A of the upper wall 21 of the housing element 50, until abutting the top of the dose 33 inside the first seat S1, to compact the dose.

The dose S1 is in effect inside the first seat S1 and supported by the first piston 13: the combined action of supporting the first piston 13 and compressing the compacting element 26 allows the dose to be compressed to a predetermined value.

Alternatively, the ejecting device 36 may act as upper contact for the dose 33 which is compressed by the action of the first piston 13. In other words, the dose 33 is compacted by moving one or other, or both, between the first piston 13 and compacting element 26, towards each other.

In practice, the dose 33 is subjected to a desired compression which determines a reduction in volume, so as to be able to dose more product inside the container 2.

The compacting element 26, after the compression is performed, is raised so as to come out of the seat S1.

At this point, the first seat S1—following a further rotation of the rotary element 9—is moved by rotation to the release substation ST3.

Simultaneously with that rotation, or immediately before or after, the position of the first seat S1 is adjusted in such a way as to move the first seat S1 from the position P1 for receiving the dose to the position P2 for releasing the dose.

In other words, the element 20, that is, the first seat S1, is moved radially, in such a way that the first seat S1 is positioned in the position P2 for releasing the dose at the substation ST3 for releasing the dose.

In the release position P2, the first seat S1, the second upper opening 23B and the second lower opening 22B are superposed on each other (that is, they occupy a shared region in plan).

Advantageously, at the release region/substation (R3/ST3) the lifting piston 23 is moved from the lowered position to the raised position, in such a way as to lift a container 2 not yet filled with product (and which must be filled with the product).

In order to perform the transfer, for a period of time depending on the speed of rotation of the rotary element 9, the first seat S1, the seat 5 of the chain 40 which carries the container 2 to be filled, the lifting piston 23 and the ejection device 36 are positioned superposed (at different heights) at the region R3 for releasing the dose.

The release of the dose 33 of product from the first seat S1 to the containing element 2 is described below.

The lifting piston 23 abuts the bottom of the container 2 in such a way as to lift the container 2.

It should be noted that the lifting piston 23 is moved (from the bottom upwards, that is, vertically) until the container 2 comes into contact with, that is moves close to, a tubular element 53 which extends downwards from the second lower opening 22B.

More specifically, the container 2 is positioned in such a way that the tubular element 53 is partially located inside it.

Advantageously, there is a transit gap between the tubular element 53 and the container 2 in a raised position, designed to minimise the escape of product from the container 2, but at the same time allow air to pass through during the release of the dose 33.

In practice, the tubular element 53 forms an extension of the second lower opening 22B; in more detail, the element 53 constitutes a channel for releasing the product from the first seat S1 to the container 2.

Once the first containing seat S1 is in release position P2, the dose 33 falls, or is pushed, towards the container 2 positioned below the tubular element 53, that is, to the second lower opening 22B.

Advantageously, so as to favour the transfer of the product from the first seat S1 to the container 2, the ejection device 36 is moved from the non-operating raised position to the lowered operating position.

During the movement from the non-operating raised position to the lowered operating position, the ejection device 36 comes into contact with the dose 33 of product which is positioned inside the first seat S1, pushing it downwards and encouraging the escape from the first seat S1.

The dose 33 is transferred from the first seat S1 to the containing element 2.

It should be noted that at the step of transferring the dose 33 from the first seat S1 to the container 2, the seat S1 and the container 2 are moved along superposed trajectories, in such a way that the container 2 is positioned below the first seat S1 for a shared stretch.

It should be noted that, after the transfer, a flow of air is preferably released on the collar 32 (upper edge) of the container 2.

For that purpose, the filling unit 1 comprises means 55 for releasing fluid, that is, air or inert gases, such as for example, nitrogen, CO2, etc., operatively associated with the release station ST3 to release a flow of fluid on the collar 32 of the container 2.

It should be noted that the ejection device 36, when the flow of fluid is released on the container 2, is in the lowered operating position.

More specifically, when the flow of fluid is released on the containing element 2, the container 2 is preferably closed by the tubular element 53, thereby preventing escape of product.

It should be noted that the release of the flow of air (by the fluid release means 55) means that the containing collar 32 of the container 2 is cleaned, in such a way that it is in perfect order for the subsequent operations, in particular for the operation of sealing a piece 34 of sealing sheet to the collar 32.

Figure 9:
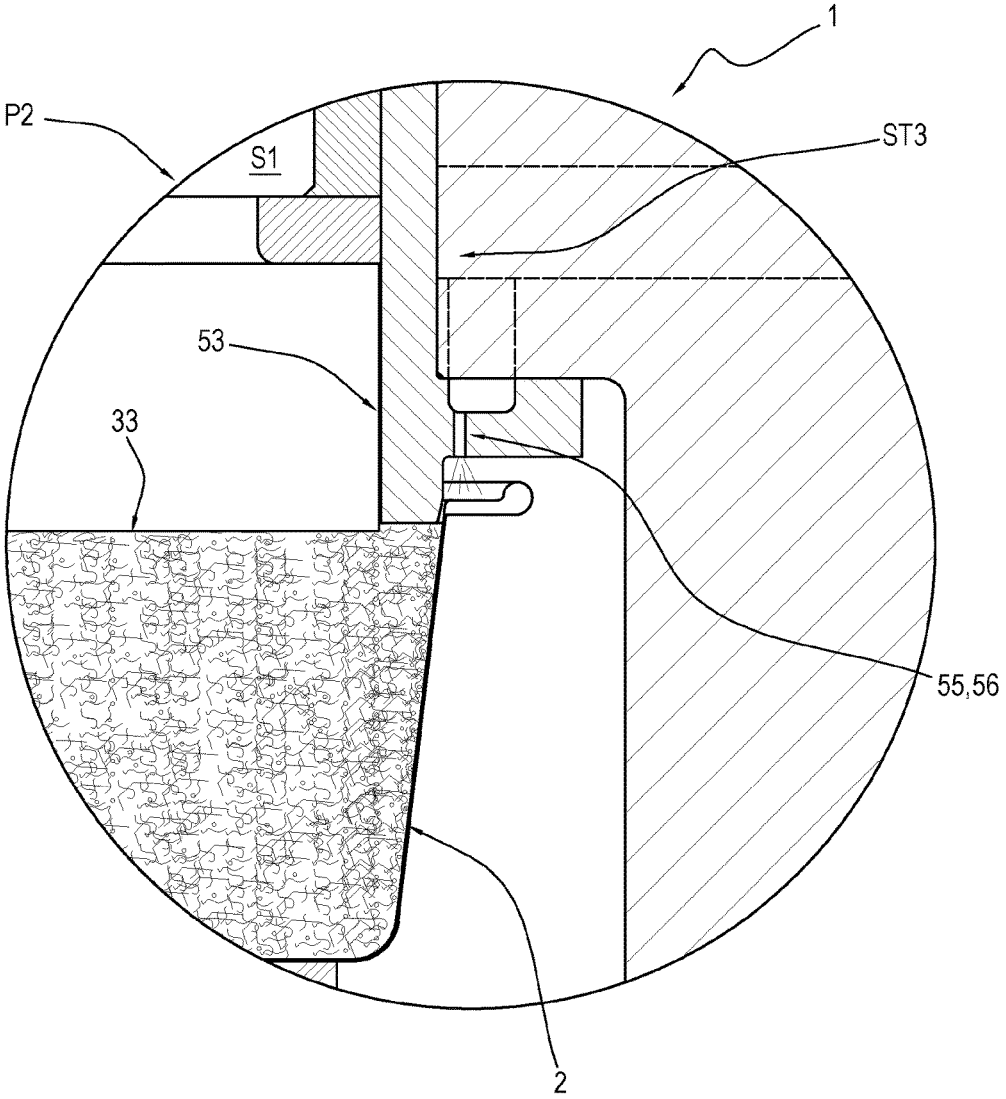
FIG. 9 shows an enlargement of a detail of the filling unit of the preceding figures.
Figure 10:
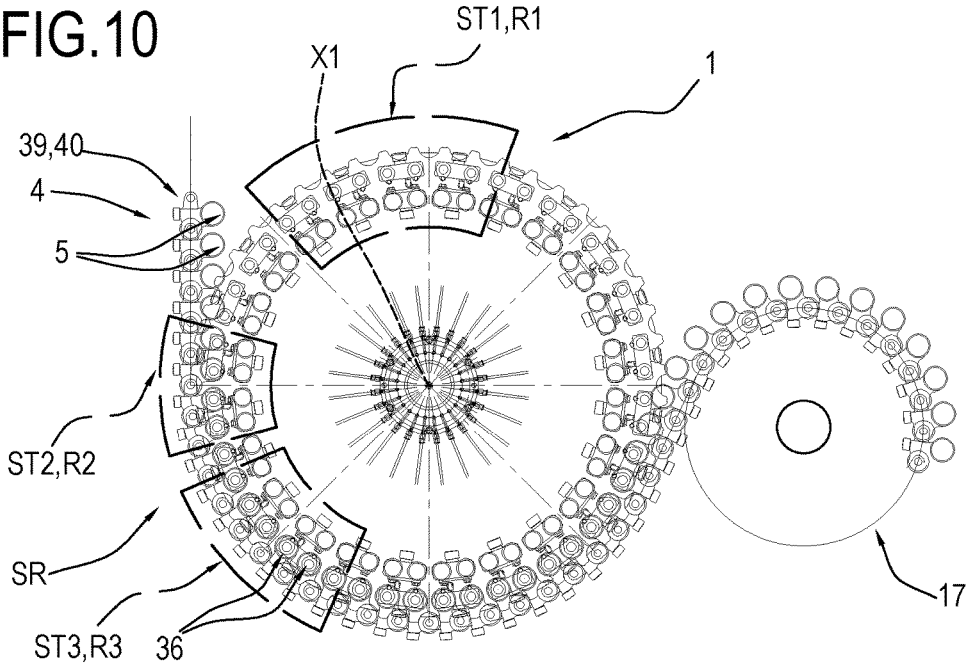
FIGS. 10 and 12 are plan views of some components of the filling unit of the preceding figures.
Figure 11:
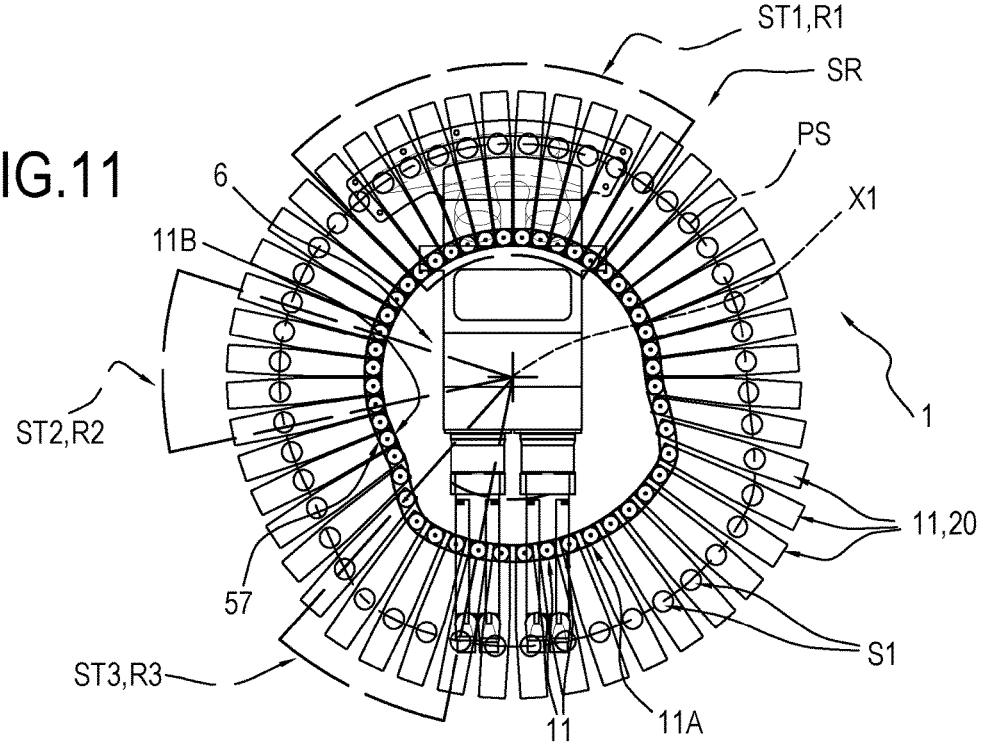

With reference to this aspect, it should be noted that the means 55 for releasing the fluid preferably comprise a nozzle 56 (clearly visible in FIG. 9). Preferably, the nozzle 56 is associated with the tubular element 53. Preferably, at least one nozzle 56 is associated with each tubular element 53.

Advantageously, the fluid release means 55 preferably comprise a source (not illustrated) fluid, such as nitrogen, CO2, other inert gases or air under pressure and a plurality of nozzles 56 in fluid connection with the source, so as to allow the release of pressurised fluid.

After transfer, the lifting piston 23 is moved from the raised position to the lowered position, so as to move the container 2 inside, and resting against, the respective seat 5 of the chain 40.

It should be noted that the filling unit 1 according to this invention is particularly simple in terms of construction and at the same time is extremely flexible, and can easily adapt to different types of products and capsules.

According to this invention, a method is also defined for filling containers forming single-use capsules for extraction or infusion beverages. As stated above, the term "containers" is deemed to mean both rigid, cup-shaped containers 2, of the type shown, and elements for filtration or retention of a dose of product connected to a rigid container.

The method according to the invention comprises the following steps:

- moving a succession of containers 2 along a first movement path P;
- moving at least one first receiving seat S1 designed to receive a dose 33 of product along a closed path PS, the moving comprising a rotation of the at least one first containing seat S1 about a first substantially vertical axis of rotation X1;
- creating a dose 33 of product inside the at least one first containing seat S1 at a region R1 for forming the dose located along the closed path PS by releasing product inside the at least one first containing seat S1;
- adjusting the position of the first seat S1 for receiving the product along the closed path PS, for positioning the first seat S1 in a position P1 for receiving the product at a predetermined region R1 for forming the dose of the closed path PS and a position R2 for releasing the dose in a container 2 at a predetermined region R3 for transfer of the dose of the closed path PS;
- releasing a dose 33 of product in a first containing seat S1 at the region R1 for forming the dose 33 of the path PS;
- transferring the dose 33 of product from the first containing seat S1 to a container 2 at the region R3 for transferring the dose of the closed path PS.

Preferably, the step of creating the dose 33 comprises a step of releasing inside the at least one first containing seat S1 a portion of a quantity of product accumulated loose in a hopper 38.

Still more preferably, the step of creating the dose comprises a step of releasing product, inside the at least one first containing seat S1, using the pushing action of a screw feeder.

It should be noted that the dose of product (which will be released in a containing seat S1) is created at the region R1 for forming the dose starting from a mass of product, which—in terms of quantity—is able to define a plurality of doses 33.

According to the method, the step of moving a succession of containers along a first movement path P preferably comprises moving the containers 2 along a path PS which is a closed loop lying on a horizontal plane.

Preferably, the succession of containers 2 is moved with continuous motion.

Moreover, the step of moving the first containing seat S1 towards the release region R3 comprises a rotation of the first seat S1 about a first vertical axis X1.

Preferably, the step of transferring the dose 33 from the first seat S1 to the container S2 comprises a step of pushing the dose 33 (preferably using an ejection device 36) from the first seat S1 to the container 2.

Preferably, the pushing step comprises making contact with the dose 33 at the top and pushing the dose 33 from the top downwards, for causing the escape from the first seat S1.

According to another aspect, during the step of moving the first seat S1 from the forming region R1 to the release region R3, the method comprises a step of compacting the dose 33 inside the first seat S1.

Preferably, the compacting step comprises abutting the top of the dose 33 (preferably using a compacting element 26) inside the first seat S1.

According to this aspect, the compacting step comprises compressing the dose 33 inside the first seat S1 by the combined action of a compacting element 26, which comes into contact with the top of the dose 33, and a first piston 13 which supports and comes into contact with the bottom of the dose 33. In practice, the dose 33 is compressed between the compacting element 26 and the first piston 13.

More generally speaking, it should be noted that the method comprises a step of compacting the dose 33 inside the first containing seat S1 after the step of releasing a dose 33 of product inside a first seat S1 and before the step of transferring the dose 33 of product from the first containing seat S1 to a container 2.

It should be noted that the step of compacting the dose 33 of product inside the first containing seat S1 comprises a step of preparing a compacting element 26 and a step of moving the compacting element 26 to compress the product inside the first seat S1, so as to compact it.

Alternatively, the step of compacting the dose 33 of product inside the first containing seat S1 comprises a step of preparing the compacting element 26 and a step of moving the first piston 13 towards the compacting element 26, to compress the product inside the first seat S1, so as to compact it.

In a further variant embodiment, the step of compacting the dose 33 of product inside the first containing seat S1 comprises a step of preparing the compacting element 26 and a step of moving both the first piston 13 and the compacting element 26 towards each other, to compress the product inside the first seat S1, so as to compact it.

According to another aspect, the above-mentioned step of adjusting the position of the first seat S1 for receiving the product comprises a step of moving the first seat S1 along a rectilinear direction according to forward and return stroke.

Advantageously, the rectilinear direction lies on a horizontal plane.

More specifically, the step of adjusting the position of the first seat S1 for receiving the product comprises a step of moving the first seat S1 radially relative to the first axis of rotation X1 according to forward and return stroke.

According to another aspect, the step of transferring the dose 33 of product from the first seat S1 to the container 2 comprises a step of preparing the ejection device 36 and a step of moving the ejection device 36 for pushing the dose 33 outside the first seat S1 and releasing the dose 33 inside the container 2.

The method described above is particularly simple and allows the creation of a dose 33 of product and the filling in a fast, clean and reliable manner of a container 2, such as a rigid, cup-shaped container of a single-use capsule 3 for extraction or infusion beverages.

The invention claimed is:

1. A filling unit for filling containers with a dose of product, comprising:

a line for transporting the containers extending along a first movement path and provided with a plurality of supporting seats for the containers arranged in succession along the first movement path;

a filling station for filling the containers with a dose of product, wherein the filling station comprises:

at least a first containing seat configured to receive the dose of product;

a movement device comprising a first element rotating about a first axis of rotation which is substantially vertical, the movement device supporting the at least one first containing seat in rotation about the first axis of rotation along a closed path; and a position adjusting device having a cam device that is arranged between the movement device and the at least one first containing seat, the position adjusting device configured for adjusting a radial position of the at least one first containing seat along the closed path, wherein the position adjusting device is configured to move the at least one first containing seat between a first radial position for receiving the dose and a second radial position for releasing the dose inside a respective container;

a forming substation for forming the dose inside the at least one first containing seat, the forming substation provided with a device for releasing a predetermined quantity of product forming the dose inside the at least one first containing seat when the at least one first containing seat is located in the first radial position for reception of the dose; and a release substation for releasing the dose from the at least one first containing seat when the at least one first containing seat is positioned in the second radial position for releasing the dose to the respective container transported by the line, wherein the at least one first containing seat is defined by lateral walls of a cavity and by a bottom wall, the filling unit comprising, for each first containing seat:

a first piston, which is movable between a lower position and an upper position and forming the bottom wall of the first containing seat when the first containing seat is in the first radial position for receiving the dose; and an electric motor, a pneumatic device, or a cam device for moving the piston between the lower and upper positions so as to adjust an internal volume of the first containing seat.

2. The filling unit according to claim 1, wherein the closed path lies on a horizontal plane.

3. The filling unit according to claim 1, wherein the closed path is a curved path.

4. The filling unit according to claim 1, comprising a plurality of first containing seats, positioned radially on the first element to be rotated by the first element so as to cyclically engage the forming and release substations.

5. The filling unit according to claim 1, wherein the position adjusting device is configured to move the at least one first containing seat radially relative to the first axis of rotation between the first radial position for receiving the dose and the second radial position for releasing the dose.

6. The filling unit according to claim 5, wherein the position adjustment device is configured to move the at least one first containing seat radially in a forward stroke from the first radial position for receiving the dose to the second radial position for releasing the dose and according to a return stroke from the second radial position for releasing the dose to the first radial position receiving the dose.

7. The filling unit according to claim 1, further comprising a compacting substation configured to compact the dose inside the first containing seat and extending along the closed path between the forming substation and the release substation.

8. The filling unit according to claim 7, further comprising at least one movable compacting element at the compacting substation for compressing the dose inside the first containing seat.

9. The filling unit according to claim 8, comprising a plurality of compacting elements, each of the compacting elements being operatively associated with a respective first containing seat.

10. The filling unit according to claim 1, comprising a lifting piston which is movable at the release substation between a lower position and an upper position in which the lifting piston lifts the container.

11. The filling unit according to claim 10, comprising a lifting piston for each first containing seat.

12. The filling unit according to claim 1, further comprising at least one ejection device movable at the release substation to abut the dose inside the at least one first containing seat, eject the dose to the outside of the first containing seat and release the dose inside the respective container.

13. The filling unit according to claim 12, comprising a plurality of ejecting devices, each of the ejecting devices being operatively associated with a respective first containing seat.

14. The filling unit according to claim 1, wherein the first containing seat is a through seat made in a containing element.

15. The filling unit according to claim 14, comprising a first piston and a housing element configured to house the containing element and equipped with a first upper opening to allow the product to enter and a compacting element designed for compacting the product in the first containing seat, a second upper opening for allowing an ejection device designed to eject the dose of product, a first lower opening for allowing the first piston, which forms a bottom wall of the first containing seat when the first containing seat is in the first radial position for receiving the dose and a second lower opening to allow the product to escape from the first containing seat.

16. The filling unit according to claim 15, wherein the containing element is slidable inside the housing element and the position adjusting device is configured for placing the first containing seat at the first upper and lower openings in the first radial position for receiving the dose and at the second upper and lower openings in the position for releasing the dose.

17. The filling unit according to claim 15, wherein the first upper opening is positioned above the first lower opening and the second upper opening is positioned above the second lower opening.

18. A packaging machine designed for packaging single-use capsules for extraction or infusion beverages, comprising:

a feeding station designed to feed the containers in corresponding supporting seats of the line for transporting the containers, a filling unit according to claim 1;

a closing station to close the containers with a respective piece of sealing sheet; and an outfeed station designed to pick up the capsules from the supporting seats of the line for transporting the containers, wherein the line for transporting the containers is configured to transport the single-use capsules.

19. A filling unit for filling containers with a dose of product, comprising:

a line for transporting the containers extending along a first movement path and provided with a plurality of supporting seats for the containers arranged in succession along the first movement path;

a filling station for filling the containers with a dose of product, wherein the filling station comprises:

at least a first containing seat that is configured to receive the dose of product and is a through seat made in a containing element;

a movement device comprising a first element rotating about a first axis of rotation which is substantially vertical, the movement device supporting the at least one first containing seat in rotation about the first axis of rotation along a closed path; and a position adjusting device having a cam device that is arranged between the movement device and the at least one first containing seat, the position adjusting device configured for adjusting a radial position of the at least one first containing seat along the closed path, wherein the position adjusting device is configured to move the at least one first containing seat between a first radial position for receiving the dose and a second radial position for releasing the dose inside a respective container;

a forming substation for forming the dose inside the at least one first containing seat, the forming substation provided with a device for releasing a predetermined quantity of product forming the dose inside the at least one first containing seat when the at least one first containing seat is located in the first radial position for reception of the dose;

a release substation for releasing the dose from the at least one first containing seat when the at least one first containing seat is positioned in the second radial position for releasing the dose to the respective container transported by the line; and a first piston and a housing element configured to house the containing element and equipped with a first upper opening to allow the product to enter and a compacting element designed for compacting the product in the first containing seat, a second upper opening for allowing an ejection device designed to eject the dose of product, a first lower opening for allowing the first piston, which forms a bottom wall of the first containing seat when the first containing seat is in the first radial position for receiving the dose and a second lower opening to allow the product to escape from the first containing seat.

* * * * *